US008783501B2

(12) United States Patent
Mookerjee

(10) Patent No.: US 8,783,501 B2
(45) Date of Patent: Jul. 22, 2014

(54) CRYOGENIC STORAGE TANK

(75) Inventor: Avijit Mookerjee, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 13/582,585

(22) PCT Filed: Mar. 17, 2010

(86) PCT No.: PCT/US2010/027658

§ 371 (c)(1),
(2), (4) Date: Sep. 4, 2012

(87) PCT Pub. No.: WO2011/115620

PCT Pub. Date: Sep. 22, 2011

(65) Prior Publication Data

US 2012/0325821 A1 Dec. 27, 2012

(51) Int. Cl.

| | |
|---|---|
| ***F17C 3/02*** | (2006.01) |
| ***B65D 25/18*** | (2006.01) |
| *B65D 6/10* | (2006.01) |
| *F17C 3/04* | (2006.01) |
| *F17C 13/00* | (2006.01) |

(52) U.S. Cl.

CPC . *B65D 25/18* (2013.01); *B65D 7/22* (2013.01); *F17C 3/04* (2013.01); *F17C 13/001* (2013.01); *F17C 3/02* (2013.01)

USPC ..... 220/560.04; 220/560.1; 220/560.12; 220/560.09; 220/4.12; 220/4.17; 52/742.14; 52/745.01; 52/745.1; 52/245; 52/581; 264/32; 264/35; 264/228; 137/264; 62/45.1; 62/54.3; 62/259.1

(58) Field of Classification Search

CPC ..... B65D 25/18; B65D 7/22; B65D 25/24; F17C 3/04; F17C 13/00; F17C 13/08

USPC ..... 220/742.14, 745.21, 249, 233.2, 322, 220/340, 245, 781.5, 169.7, 364, 560.1, 220/565, 445, 444, 4.12, 560.12, 560.04, 220/560.09; 52/560.1, 565, 445, 444, 4.12, 52/469, 450, 560.4, 581, 742.14, 742.15, 52/745.01; 62/45.1, 259.1, 53.2; 137/72, 137/80, 264; 264/32, 35, 228

See application file for complete search history.

(56) References Cited

U.S. PATENT DOCUMENTS 1,964,870 A * 7/1934 Chappell ..... 264/32
1,966,244 A * 7/1934 Hansen ..... 220/565

(Continued)

FOREIGN PATENT DOCUMENTS

DE 3107931 A1 9/1982
DE 19949189 A1 * 4/2001 ..... F17C 3/08

(Continued)

OTHER PUBLICATIONS

European Patent Office, International Search Report and Written Opinion of the International Searching Authority, mailed Jul. 13, 2010, for PCT/US2010/027658.

*Primary Examiner* — Mickey Yu
*Assistant Examiner* — Gideon Weinerth
(74) *Attorney, Agent, or Firm* — Eric J. Schaal

(57) ABSTRACT

An apparatus and method for constructing a cryogenic storage tank (700) having a welded inner tank (702), an outer shell (704) surrounding the welded inner tank (702), a concrete foundation (728) comprising a raised portion (752), a plurality of cellular glass blocks (734) positioned directly on top of the raised portion (752) of the concrete foundation (728), a leveling course of concrete (736) poured on top of the uppermost layer of the plurality of cellular glass blocks (734), and a mounting apparatus (718) affixed to the concrete foundation (728), where the welded inner tank (702) is positioned on top of the leveling course of concrete (736) and the outer shell (704) is affixed to the mounting apparatus (718) at locations around the periphery of the outer shell (704).

16 Claims, 14 Drawing Sheets

(56) References Cited

U.S. PATENT DOCUMENTS

| | | | | | |
|---|---|---|---|---|---|
| 2,117,314 | A | * | 5/1938 | Goodrich | 220/565 |
| 2,126,997 | A | * | 8/1938 | Kramer | 228/140 |
| 2,332,227 | A | * | 10/1943 | Jackson | 405/131 |
| 2,520,883 | A | * | 8/1950 | Kornemann et al. | 220/560.05 |
| 2,563,118 | A | | 8/1951 | Jackson | |
| 2,684,173 | A | * | 7/1954 | Schmitz | 220/645 |
| 2,777,295 | A | * | 1/1957 | Bliss et al. | 62/45.1 |
| 2,911,125 | A | * | 11/1959 | Dosker | 220/560.05 |
| 2,953,276 | A | * | 9/1960 | Dunn | 220/4.17 |
| 2,955,723 | A | * | 10/1960 | McGrath | 220/565 |
| 3,025,993 | A | * | 3/1962 | Horton et al. | 220/560.05 |
| 3,076,317 | A | * | 2/1963 | La Fave | 405/131 |
| 3,196,622 | A | * | 7/1965 | Smith et al. | 62/53.1 |
| 3,246,479 | A | * | 4/1966 | Kelley | 62/47.1 |
| 3,274,785 | A | * | 9/1966 | Lange | 405/131 |
| 3,338,010 | A | * | 8/1967 | Waugh | 52/249 |
| 3,378,162 | A | * | 4/1968 | Smith | 220/560.05 |
| 3,446,888 | A | * | 5/1969 | Crowley | 264/256 |
| 3,448,886 | A | * | 6/1969 | Todd et al. | 220/560.12 |
| 3,481,504 | A | * | 12/1969 | Nelson | 220/560.05 |
| 3,491,910 | A | * | 1/1970 | Buckwalter et al. | 220/560.12 |
| 3,514,913 | A | | 6/1970 | Nelson | |
| 3,559,835 | A | * | 2/1971 | Lange | 220/560.12 |
| 3,595,423 | A | * | 7/1971 | Yamamoto | 220/560.05 |
| 3,606,067 | A | * | 9/1971 | Jones | 220/560.06 |
| 3,633,878 | A | * | 1/1972 | Mendius, Jr. | 366/114 |
| 3,685,232 | A | * | 8/1972 | Steffen | 52/741.15 |
| 3,687,149 | A | | 8/1972 | Wissmiller | |
| 3,852,973 | A | * | 12/1974 | Marothy | 62/45.1 |
| 3,889,836 | A | * | 6/1975 | Anderson | 220/565 |
| 3,931,424 | A | * | 1/1976 | Helf et al. | 428/33 |
| 3,935,957 | A | * | 2/1976 | Hasegawa | 220/560.1 |
| 4,041,722 | A | * | 8/1977 | Terlesky et al. | 62/45.1 |
| 4,044,522 | A | * | 8/1977 | Sturmer et al. | 52/599 |
| 4,069,642 | A | * | 1/1978 | Hendriks | 52/223.2 |
| 4,073,976 | A | * | 2/1978 | Dudzinski | 427/181 |
| 4,126,976 | A | * | 11/1978 | Crowley | 52/223.3 |
| 4,136,493 | A | * | 1/1979 | Bradford et al. | 52/169.7 |
| 4,170,952 | A | * | 10/1979 | McCown | 114/74 A |
| 4,249,352 | A | * | 2/1981 | Marchaj | 52/167.1 |
| 4,365,478 | A | * | 12/1982 | Stori et al. | 62/45.1 |
| 4,366,654 | A | * | 1/1983 | Bomhard | 52/223.2 |
| 4,426,817 | A | * | 1/1984 | Bomhard | 52/262 |
| 4,461,399 | A | * | 7/1984 | Sattelberg et al. | 220/565 |
| 4,467,587 | A | * | 8/1984 | Montagnan | 52/169.14 |
| 4,498,602 | A | * | 2/1985 | Sattelberg et al. | 220/560.05 |
| 4,513,550 | A | * | 4/1985 | Kotcharian | 52/745.01 |
| 4,603,525 | A | * | 8/1986 | Byers et al. | 52/245 |
| 4,871,081 | A | * | 10/1989 | Ershig | 220/565 |
| 5,018,639 | A | * | 5/1991 | Schafer | 219/385 |
| 5,501,359 | A | * | 3/1996 | Chauvin et al. | 220/592.26 |
| 5,649,433 | A | | 7/1997 | Suzuki et al. | |
| 7,043,887 | B2 | * | 5/2006 | Van Ootmarsum | 52/741.4 |
| 7,162,844 | B2 | * | 1/2007 | Morrison et al. | 52/245 |
| 7,344,046 | B1 | * | 3/2008 | Larson et al. | 220/565 |
| 8,603,375 | B2 | * | 12/2013 | Simmons et al. | 264/31 |
| 2011/0099940 | A1 | * | 5/2011 | Yang et al. | 52/742.14 |
| 2011/0283638 | A1 | * | 11/2011 | Shockley et al. | 52/231 |
| 2013/0200077 | A1 | * | 8/2013 | Nishizaki et al. | 220/560.1 |

FOREIGN PATENT DOCUMENTS

| | | | |
|---|---|---|---|
| FR | 2349099 | A1 | 11/1977 |
| FR | 2735847 | A1 | 12/1996 |
| GB | 398439 | A | 9/1933 |
| GB | 1030858 | A | 5/1966 |
| JP | 2001349498 | A | 12/2001 |
| TW | 293074 | B | 12/1996 |
| TW | 308631 | B | 6/1997 |

* cited by examiner

CRYOGENIC STORAGE TANK

BACKGROUND

As recently as the 1950's, double walled spherical tanks 100, illustrated in FIG. 1, were used for cryogenic liquid storage. These double walled spherical tanks 100 were supported on tubular carbon steel legs 102. The double walled spherical tanks 100 were typically ten feet to fifteen feet in diameter and comprising an inner stainless steel welded shell 104 and an outer carbon steel welded shell 106. The bottom third of the void space between the inner stainless steel welded shell 104 and the outer carbon steel welded shell 106 was filled with cellular glass blocks 108 and the remainder was filled with a perlite insulation material 110. The tubular carbon steel legs 102 were supported by a concrete foundation 112 on grade 114 and fastened to the concrete foundation 112 using an anchor bolt assembly 116.

Traditional Welded Flat Bottom Cryogenic Liquid Storage Tanks

As the industry demand for liquid volumes increased, however, the cryogenic liquid storage industry moved away from using the doubled walled spherical tanks 100 and began to use welded shell flat bottom cryogenic liquid storage tanks 200 illustrated in FIG. 2. The cryogenic liquid storage industry moved to welded shell flat bottom cryogenic liquid storage tanks 200 primarily because of their ability to hold larger liquid volumes, their comparatively low cost of construction, and their ease of maintenance.

Traditional welded shell flat bottom cryogenic liquid storage tanks 200 continue to be designed and manufactured using the same philosophy since the late 1950's. As illustrated in FIG. 2, the traditional welded shell flat bottom cryogenic liquid storage tank 200 comprises an inner tank 202 and an outer tank 204 with a void space 206 between the inner tank 202 and the outer tank 204. The void space 206 is generally filled with perlite insulation 208.

The inner tank 202 is a pressurized stainless steel welded tank that holds the cryogenic liquid. The inner tank 202 comprises a stainless steel floor plate 210, rolled stainless steel wall staves 212, and a stainless steel roof dome 214. The stainless steel floor plate 210, rolled stainless steel wall staves 212, and stainless steel roof dome 214 are all site-welded using stainless steel electrodes and then weld-tested at the installation site.

The outer tank 204 includes a carbon steel floor plate 216, rolled carbon steel wall staves 218, and a carbon steel roof dome 220 that are all shop fabricated but are not shop finished due to the required extensive field welding.

The traditional welded shell flat bottom cryogenic liquid storage tank 200 is supported first by a plurality of concrete columns or piles 222 that may be entrenched in grade 224. The piles 222 support an elevated concrete foundation 226. The elevated concrete foundation 226 may be approximately three feet to four feet thick, for example. The elevated concrete foundation 226 supports the carbon steel floor plate 216. The carbon steel floor plate 216 then supports a first leveling course of concrete 228. The first leveling course of concrete 228 may be three inches to four inches thick, for example. Cellular glass blocks 230 then rest on the first leveling course of concrete 228. The cellular glass blocks 230 may be stacked four feet thick, for example. The function of the cellular glass blocks 230 is to provide the required insulation so that the temperature of the surface of the elevated concrete slab 226 remains close to ambient temperature. A second leveling course of concrete 232 then rests on the cellular glass blocks 230. The second leveling course of concrete 232 may be three inches to four inches thick, for example. Finally, the stainless steel floor plate 210 rests on top of the second leveling course of concrete 232.

As illustrated in FIG. 3, which is a close-up cut away section of the lower section of the traditional welded shell flat bottom cryogenic liquid storage tank 200 in FIG. 2, a liquid withdrawal pipe 234 may be inserted through the bottom of the stainless steel floor plate 210 of the inner tank 202 and run to a metered tank trailer fill distribution system (not shown) for storage of the cryogenic liquid. Rockwool insulation 236 is wrapped around the liquid withdrawal pipe 234 to provide adequate insulation since the cellular glass blocks 230 are solid and are not easily molded to form around the liquid withdrawal pipe 234. Further, a stainless steel box section 238 is installed to form a tunnel way through the cellular glass blocks 230 for the liquid withdrawal pipe 234. A protection ring or retaining wall 240 provides further support to the top layers of foundation of cellular glass blocks 230 and second leveling course of concrete 232.

A carbon steel anchor strap 242 is used to anchor the outer tank 204 to the elevated concrete foundation 226. The carbon steel anchor strap 242 may be entrenched in the elevated concrete foundation 226, for example. A stainless steel anchor strap 244 is used to anchor the inner tank 202 to the elevated concrete foundation 226. The stainless steel anchor strap 244 also may be entrenched in the elevated concrete foundation 226, for example.

The carbon steel floor plate 216 of the outer tank 204 is typically laid out on top of the elevated concrete foundation 226 and welded in place at pre-determined, shop-cut, and prepared seams. The welds are vacuum tested prior to proceeding with the pour of the first leveling course of concrete 228.

FIG. 4 is a close-up view of the anchorage, including the carbon steel anchor straps 242, the elevated concrete foundation 226, the stainless steel anchor straps 244, the rolled stainless steel wall staves 212, and the rolled carbon steel wall staves 218 of an exemplary traditional welded shell flat bottom cryogenic liquid storage tank 200 used today.

As illustrated in FIG. 5, the erection sequence of the traditional welded shell flat bottom cryogenic liquid storage tank 200 requires multiple time-consuming steps. First, the ground 224 is graded, the piles 222 are installed, the elevated concrete foundation 226 is poured, and the carbon steel anchor straps 242 and stainless steel anchor straps 244 are embedded in the elevated concrete foundation 226 in step 500. It should be noted that traditionally twenty-eight (28) days of curing time is required for each pour of concrete. Next, the carbon steel floor plate 216 is laid out and welded on top of the elevated concrete foundation 226 and the weld seams are vacuum tested to determine their integrity in step 502. The first leveling course of concrete 228 is then poured on the top of the carbon steel floor plate 216 in step 504. The cellular glass blocks 230 are then installed on the first leveling course of concrete 228 and the liquid withdrawal pipe 234, Rockwool insulation 236, and stainless steel box 238 are established in the cellular glass blocks 230 in step 506. The second leveling course of concrete 232 is then put down on top of the cellular glass blocks 230 in step 508. The stainless steel floor plate 210 is laid out and all the seams are welded and weld-tested in step 510. Next, the rolled carbon steel wall staves 218 are then welded to each other to form a ring of rolled carbon steel wall staves 218, the ring of rolled carbon steel wall staves 218 are welded to the carbon steel floor plate 216 and the carbon steel anchor straps 242, and all welds are tested in step 512. The rolled stainless steel wall staves 212 are then welded to each other to form a ring of rolled stainless steel wall staves 212, the ring of rolled stainless steel wall staves 212 are then welded to the stainless steel floor plate 210 and the stainless steel anchor straps 244, and all welds are radiographically tested in step 514. The pre-assembled stainless steel roof dome 214 is then welded and weld-tested to the top course of the welded rolled stainless steel wall staves 212 in step 516. The pre-assembled carbon steel roof dome 220 of the outer tank 204 is welded to the top course of the rolled carbon steel wall staves 218 and weld-tested in step 518. The inner tank 202 is then hydropneumatically tested to simulate actual operating pressures in step 520. The outer tank 204 is vacuum tested to simulate actual operating pressures in step 522. The liquid withdrawal pipe 234 is then connected to the distribution system (not shown), the piping welds are pressure tested, and the entire welded shell flat bottom cryogenic liquid storage tank 200 is cleaned in step 524. Next, the outer tank 204 is primed and painted to the required specifications in step 526. Finally, the perlite insulation 208 is installed in the void space 206 between the inner tank 202 and outer tank 204 in step 528. The traditional welded shell flat bottom cryogenic liquid storage tank 200 construction is then complete and it is ready for service.

FIG. 6 is a plan view of anchorage locations for both the inner tank 202 and the outer tank 204 of a traditional welded shell flat bottom cryogenic liquid storage tank 200 currently used today and welded stainless steel inner tank 702 and the carbon steel bolted outer tank 704 of the exemplary cryogenic liquid storage tank 700.

Typical applied loads on a traditional welded shell flat bottom cryogenic liquid storage tank 200 include wind loads, seismic loads, weather loads due to snow or ice, for example, dead loads, internal pressure loads such as purge pressure, perlite vertical and horizontal loads and perlite compaction loads. In these typical conditions, the traditional welded shell flat bottom cryogenic liquid storage tank 200 is subject to cyclic compaction loads of the perlite 208 when the perlite insulation 208 itself is subjected to loads when the inner tank 202 expands and contracts due to the change in the level of the cryogenic liquid in the inner tank 202.

The inner tank 202 is designed for wind loads, seismic loads, external purge pressure, perlite vertical and horizontal loads and perlite compaction loads and additional loads due to liquid heads and internal pressure.

Previous and current manufacturing methods and use of traditional welded shell flat bottom cryogenic liquid storage tank 200 are problematic for several reasons. First, field construction of a traditional welded shell flat bottom cryogenic liquid storage tank 200 is a very tedious and lengthy process. For example, for an average sized traditional welded shell flat bottom cryogenic liquid storage tank 200 having a diameter of approximately fifty feet and a height of approximately fifty feet, field construction may exceed six months or more. The number of steps required to shop-fabricate, transport, field assemble, and test all field assembled components of the traditional welded shell flat bottom cryogenic liquid storage tank 200 are numerous, time consuming, and very expensive.

Second, since the traditional welded shell flat bottom cryogenic liquid storage tank 200 takes so long to construct, the daily revenue earning of an operating plant is lost until the traditional welded shell flat bottom cryogenic liquid storage tank 200 has been completed and ready for service, thus, seriously hindering the larger plant design critical path.

Finally, since the outer shell 204 of the traditional welded shell flat bottom cryogenic liquid storage tank 200 is field primed and field painted due to the fact that extensive field welding is necessary to assemble the outer tank 204, the field finish placed on the outer shell 204 cannot be as hard wearing as, for example, a shop baked powder coated finish applied under controlled conditions in a shop setting. The longevity of the field finish is much lower than that of a shop finished outer shell 204, and frequent maintenance and recoating is necessary during plant operation, leading to further time and capital costs.

Bolted Shell Tanks

Bolted carbon steel shell tanks sold by, for example, Columbian TecTank, Tank Connection, and Allstate Tanks have been manufactured and used traditionally for both dry and liquid storage in the agriculture, cement, and oil industries for over fifty years. The bolted shell tanks are used for dry storage of materials such as grains, cement, limestone, clinkers, etc. and for liquids such as sour crude, water, and waste sludge. The typical applied loads on a bolted shell tank for dry storage and liquid storage, consist of wind loads, seismic loads, weather loads due to snow or ice, for example, dead loads, internal pressure loads such as purge pressure, perlite vertical and horizontal loads, and liquid heads (if used for a liquid storage tank).

SUMMARY

The described embodiments satisfy the long-felt, but unresolved, need in the art by disclosing, in a first embodiment, a cryogenic storage tank, including a concrete foundation comprising a raised portion, a plurality of cellular glass blocks positioned directly on top of the raised portion of the concrete foundation, a leveling course of concrete poured on top of the uppermost layer of the plurality of cellular glass blocks, a mounting apparatus affixed to the concrete foundation, a welded inner tank comprising an inner tank floor plate, a plurality of inner tank wall staves, and an inner tank roof dome, wherein the welded inner tank is positioned on top of the leveling course of concrete, and a bolted outer shell comprising a plurality of bolted outer shell wall staves and an outer shell roof dome, wherein the bolted outer shell is positioned on top of the mounting apparatus, surrounding the welded inner tank, and spaced apart from the welded inner tank such that the plurality of inner tank wall staves are positioned adjacent to the plurality of bolted outer shell wall staves and the inner tank roof dome is positioned adjacent to the outer shell roof dome, wherein the bolted outer housing is affixed to the mounting apparatus at locations around the periphery of the bolted outer shell.

In an alternative second embodiment, the mounting apparatus of the cryogenic storage tank of the first embodiment is a carbon steel compression ring.

In an alternative third embodiment, the bolted outer shell of the cryogenic storage tank in any one of the first to the second embodiments is a carbon steel bolted outer shell.

In an alternative fourth embodiment, the welded inner tank of the cryogenic storage tank in any one of the first to the third embodiments is a welded stainless steel inner tank.

In an alternative fifth embodiment, the concrete foundation of the cryogenic storage tank in any one of the first to the fourth embodiments is an elevated concrete foundation.

In an alternative sixth embodiment, the carbon steel compression ring of the cryogenic storage tank in any one of the second to the fifth embodiments is embedded in the elevated concrete foundation.

In an alternative seventh embodiment, the carbon steel compression ring of the cryogenic storage tank in any one of the second to the sixth embodiments comprises a welded form bar.

In an alternative eighth embodiment, the carbon steel compression ring of the cryogenic storage tank in any one of the second to the sixth embodiments comprises a welded angle.

In an alternative ninth embodiment, the mounting apparatus of the cryogenic storage tank in any one of the first to the eighth embodiments comprises an anchor bolt template, at least one layer of epoxy grout, and a carbon steel compression ring.

In an alternative tenth embodiment, a method for construction of a cryogenic storage tank is disclosed, comprising the steps of: pouring and curing a concrete foundation including a raised portion by using a mounting apparatus embedded in the concrete foundation as a form for the raised portion, installing a plurality of cellular glass blocks on the raised portion of the poured and cured concrete foundation, pouring and curing a leveling course of concrete on top of the installed plurality of cellular glass blocks, installing a floor plate on top of the leveling course of concrete, installing a plurality of bolted wall staves to the concrete foundation by securing the lowest level of bolted wall staves to the embedded mounting apparatus, welding a plurality of wall staves to the floor plate, welding a first roof dome to the highest level of the plurality of welded wall staves to form a welded inner tank, and installing a second roof dome to the highest level of the plurality of bolted wall staves to form a bolted outer tank.

In an alternative eleventh embodiment, the concrete foundation, made in accordance of the method for construction of a cryogenic storage tank in the tenth embodiment, is an elevated concrete foundation.

In an alternative twelfth embodiment, the bolted wall staves, the second roof dome, and the mounting apparatus, made in accordance of the method for construction of a cryogenic storage tank in any one of the tenth to the eleventh embodiments are composed of carbon steel, and the floor plate, welded wall staves, and first roof dome are composed of stainless steel.

In an alternative thirteenth embodiment, the method for construction of the cryogenic storage tank in any one of the tenth to the twelfth embodiments includes hydropneumatically testing the welded inner tank.

In an alternative fourteenth embodiment, the method for construction of the cryogenic storage tank in any one of the tenth to the thirteenth embodiments includes vacuum testing the bolted outer shell.

In an alternative fifteenth embodiment, the method for construction of a cryogenic storage tank in any one of the tenth to the fourteenth embodiments includes installing perlite insulation in a void space between the welded inner tank and the bolted outer shell.

In an alternative sixteenth embodiment, the method for construction of a cryogenic storage tank in any one of the tenth to the fifteenth embodiments includes installing stainless steel anchor straps to the concrete foundation and the welded inner tank.

In an alternative seventeenth embodiment, the method for construction of a cryogenic storage tank in any one of the tenth to the sixteenth embodiments includes installing a stainless steel box, a liquid withdrawal pipe, and Rockwool insulation in the plurality of cellular glass blocks.

In an alternative eighteenth embodiment, a cryogenic storage tank is disclosed, comprising: a welded inner tank, an outer shell surrounding the welded inner tank, a concrete foundation comprising a raised portion, a plurality of cellular glass blocks positioned directly on top of the raised portion of the concrete foundation, a leveling course of concrete poured on top of the uppermost layer of the plurality of cellular glass blocks, and a mounting apparatus affixed to the concrete foundation, wherein the welded inner tank is positioned on top of the leveling course of concrete and the outer shell is affixed to the mounting apparatus at locations around the periphery of the outer shell.

In an alternative nineteenth embodiment, the welded inner tank of the cryogenic storage tank of the eighteenth embodiment is a stainless steel inner tank, the outer shell is a carbon steel bolted outer shell, the concrete foundation is an elevated concrete foundation, and the mounting apparatus is a carbon steel compression ring.

The disclosed methods and apparatuses reduce time and cost in the design and construction of at least one of the exemplary cryogenic storage tanks disclosed by replacing the carbon steel bottom plate of the outer tank with mounting apparatus that may act as a template for the outer shell anchor bolts, a compression plate for the outer shell of the tank, and a form plate for the pouring of the concrete foundation with a raised portion, thereby saving time by combining two concrete pours into one pour and effectively reducing the curing time necessary for two separate concrete pours. Traditionally, twenty-eight (28) days of curing time is required for each pour of concrete.

The disclosed methods and apparatuses also disclose use of an outer shell or tank, which may be a bolted shell that is shop finished and oven baked under controlled shop conditions instead of the welded shell flat bottom cryogenic liquid storage tank.

BRIEF DESCRIPTION OF SEVERAL VIEWS OF THE DRAWINGS

The foregoing summary, as well as the following detailed description of exemplary embodiments, is better understood when read in conjunction with the appended drawings. For the purpose of illustrating embodiments, there is shown in the drawings exemplary constructions; however, the invention is not limited to the specific methods and instrumentalities disclosed. In the drawings.

DETAILED DESCRIPTION

Embodiments of the invention include a new design and manufacturing method for a cryogenic liquid storage tank that will drastically reduce field construction time and capital costs. In some instances, the field construction time may be reduced from six months to approximately three months, for example, thereby saving substantial time and capital costs. The cost savings in time of construction through the elimination of work, labor requirements, elimination of weld testing for the outer tank shell, and the ease of installation of bolted stave panels are estimated to be approximately 50% of the traditional welded shell flat bottom cryogenic liquid storage tanks 200.

Figure 7:
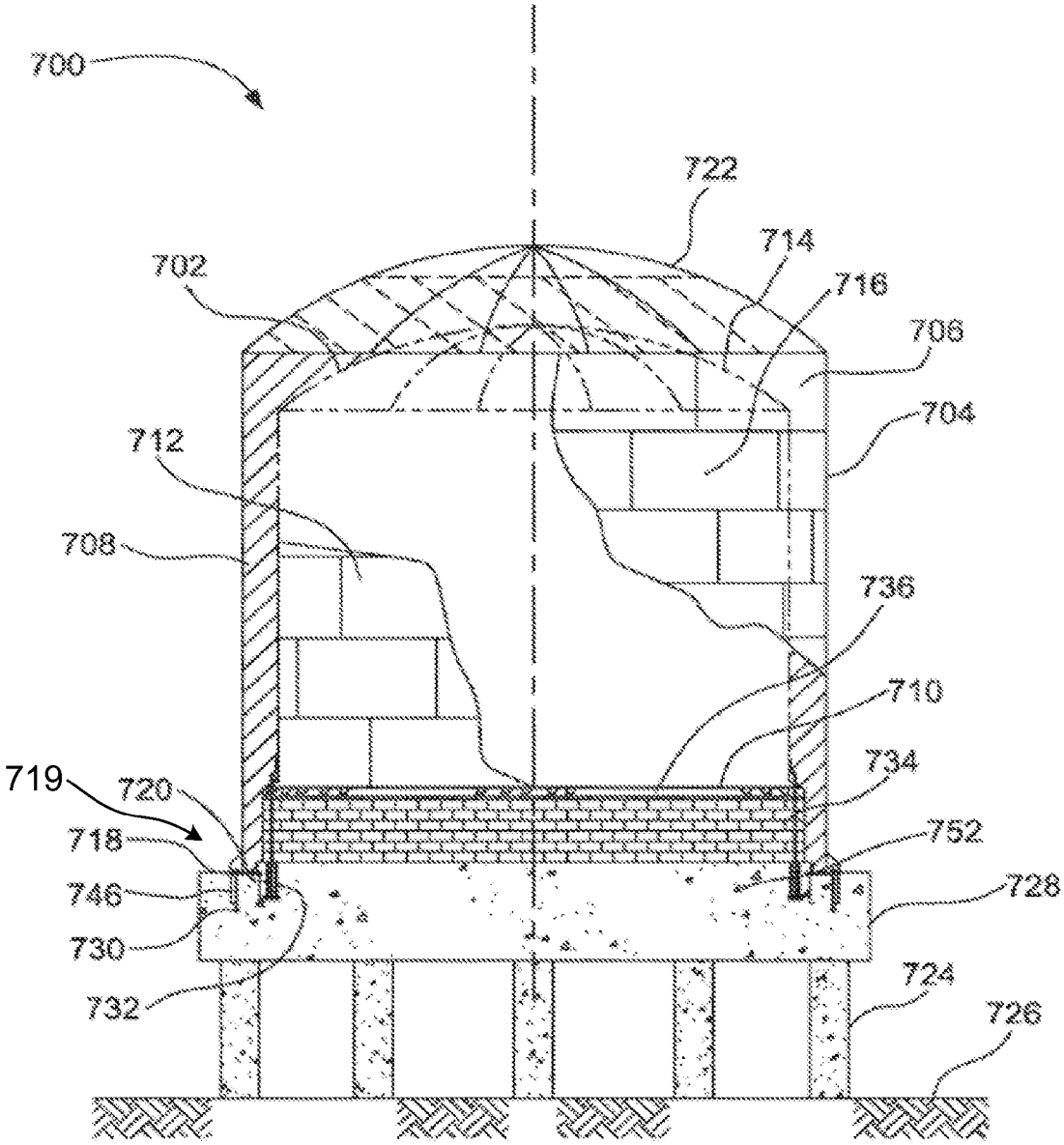
FIG. 7 is a perspective cut-away view of an exemplary cryogenic storage tank involving aspects of the invention.

FIG. 7 is a perspective cut-away view of an exemplary cryogenic storage tank 700 involving aspects of the invention. As illustrated in FIG. 7, the exemplary cryogenic liquid storage tank 700 comprises a welded inner tank 702 and bolted outer tank or shell 704 with a void space 706 between the welded inner tank 702 and the bolted outer tank 704. The bolted outer tank or shell 704 acts as a shell or housing for the welded inner tank 702. The welded inner tank 702, and its components, may be constructed of stainless steel, aluminum, an alloy, or other cryogenic tolerant materials, for example. For simplicity, the welded inner tank 702, and its components, shall be referred to hereinafter as being constructed of stainless steel for convenience purposes only. The bolted outer tank or shell 704, and it components, may be constructed of carbon steel, fiber reinforced concrete, fiber glass, or other composite materials, for example, including, but not limited to, cast-in-place or shop-fabricated panels. For simplicity, the bolted outer tank or shell 704, and its components, shall be referred to hereinafter as being constructed of carbon steel for convenience purposes only. Notably, the bolted outer tank or shell 704 may be circular shaped, but it may also be cubed shaped or suitably shaped to form a housing around the welded inner tank 702.

The void space 706 is generally filled with perlite insulation 708. The void space 706 may also be filled with other types of insulation material. The carbon steel bolted outer tank 704 may be an API-12B fluted shell, for example, or a Rolled Tapered Panel bolted shell, for example.

Use of the carbon steel bolted outer tank 704 eliminates the requirement to field weld, field test, and field coat the outer tank, thus, saving months of field time because the carbon steel bolted outer tank 704 can be constructed comparatively quickly and pre-painted prior to shipping. First, welding is a time-consuming process that requires extensive testing after completion. Bolted panels require much less time to construct and test, thus, providing a solution to the long-felt, but unsolved need, in this industry to reduce construction time and costs in the construction of cryogenic storage tanks. Second, bolted panels are shop finished under controlled shop conditions, whereas the traditional field welded panels need to be field-primed and finished and cannot compare to shop finish bolted panels in terms of durability and quality.

The welded stainless steel inner tank 702 is a pressurized tank that holds, for example, the cryogenic liquid. The welded stainless steel inner tank 702 comprises a stainless steel floor plate 710, rolled stainless steel wall staves 712, and a stainless steel roof dome 714. The stainless steel floor plate 710, rolled stainless steel wall staves 712, and stainless steel roof dome 714 are all site welded using stainless steel electrodes and then weld-tested at the installation site.

The carbon steel bolted outer tank 704 comprises bolted outer tank wall staves 716, a mounting apparatus 719, welded form bars 720, and a carbon steel roof dome 722. The mounting apparatus 719 may be a carbon steel compression ring 718, for example. For simplicity, the mounting apparatus 719 shall be referred to hereinafter as a carbon steel compression ring 718 for convenience purposes only. The carbon steel floor plate 216 from the traditional welded shell flat bottom cryogenic liquid storage tank 200 is eliminated and replaced with the carbon steel compression ring 718 and welded form bars 720 that serve as both a form for the poured concrete (i.e., the concrete poured to create the elevated concrete foundation 728) as well as a template for the anchor bolts 730 of the carbon steel bolted outer tank 704. The carbon steel compression ring 718 may be embedded in the elevated concrete foundation 728 and could serve as the compression plate for the carbon steel bolted outer tank 704. The carbon steel compression ring 718 may be in the shape of a ring, for example, but it may also be form in the shape of an octagon, a heptagon, a hexagon, or some other similar shape. Further, the carbon steel compression ring 718 may not be a continuous shape, but a series of arcs, for example, making up a non-continuous shape, or a plurality of small plates positioned separate and apart from each other but in a circular pattern.

Like the traditional welded shell flat bottom cryogenic liquid storage tank 200, the exemplary cryogenic liquid storage tank 700 is supported first by a plurality of concrete columns or piles 724 that may be entrenched in grade 726. The piles 724 support an elevated concrete foundation 728. The elevated concrete foundation 728 may be approximately three feet to four feet thick, for example, and may be reinforced. The embedded carbon steel compression ring 718 and the welded form bar 720 are embedded into the elevated concrete foundation 728 along with carbon steel anchor bolts 730, the reinforcing bars 746 and the stainless steel anchor straps 732 for the welded stainless steel inner tank 702, illustrated in FIG. 8. The reinforcing bars 746 are welded to the underside of the embedded carbon steel compression ring 718 and are embedded in the concrete to keep the embedded carbon steel compression ring 718 in place during pouring of the concrete and to develop pullout strength. Courses of cellular glass blocks 734 are installed on a raised portion 752 of the elevated concrete foundation 728. The cellular glass blocks 734 may stacked three feet to four feet high, for example. The function of the cellular glass block 734 is to act as insulation so that the top surface of the elevated concrete foundation 728, or if present, the raised portion 752 of the elevated concrete foundation 728, is kept close to ambient temperature. The function of the raised portion 752, like the first leveling course of concrete 228 of the traditional welded shell flat bottom cryogenic storage tank 200, is to act as a line of defense if a cryogenic liquid leak were to occur. Leaking cryogenic liquid would likely damage the raised portion 752 first, thus, minimizing the damage to the elevated concrete foundation 728. Having the raised portion 752 as a line of defense will also provide more time for plant personnel to react and drain the leaking tank and address cause of the leak and any damage to the concrete.

A leveling course of concrete 736 then rests on the cellular glass blocks 734. The leveling course of concrete 736 may be may be three inches to four inches thick, for example. The purpose of the leveling course of concrete 736 is to provide a hard wearing surface for the stainless steel floor plate 710 to be laid out and welded and as yet another line of defense from cryogenic leaks damaging the elevated concrete foundation 728. Finally, the stainless steel floor plate 710 rests on top of the leveling course of concrete 736.

Use of the embedded carbon steel compression ring 718 in this way combines the two concrete pours (i.e., the concrete pours for the elevated concrete foundation 226 and the first leveling course of concrete 228) saving at least another twenty-eight (28) days of schedule field time (i.e., because the each concrete pour takes approximately twenty-eight (28) days to cure). Omission of the carbon steel floor plate 216 from the traditional welded shell flat bottom cryogenic liquid storage tank 200 with the embedded carbon steel compression ring 718 also eliminates the need for a separate first leveling course of concrete 228 for the cellular glass blocks 734 as one may be poured along with the elevated concrete foundation 728 pour (i.e., the raised portion 752).

Figure 8:
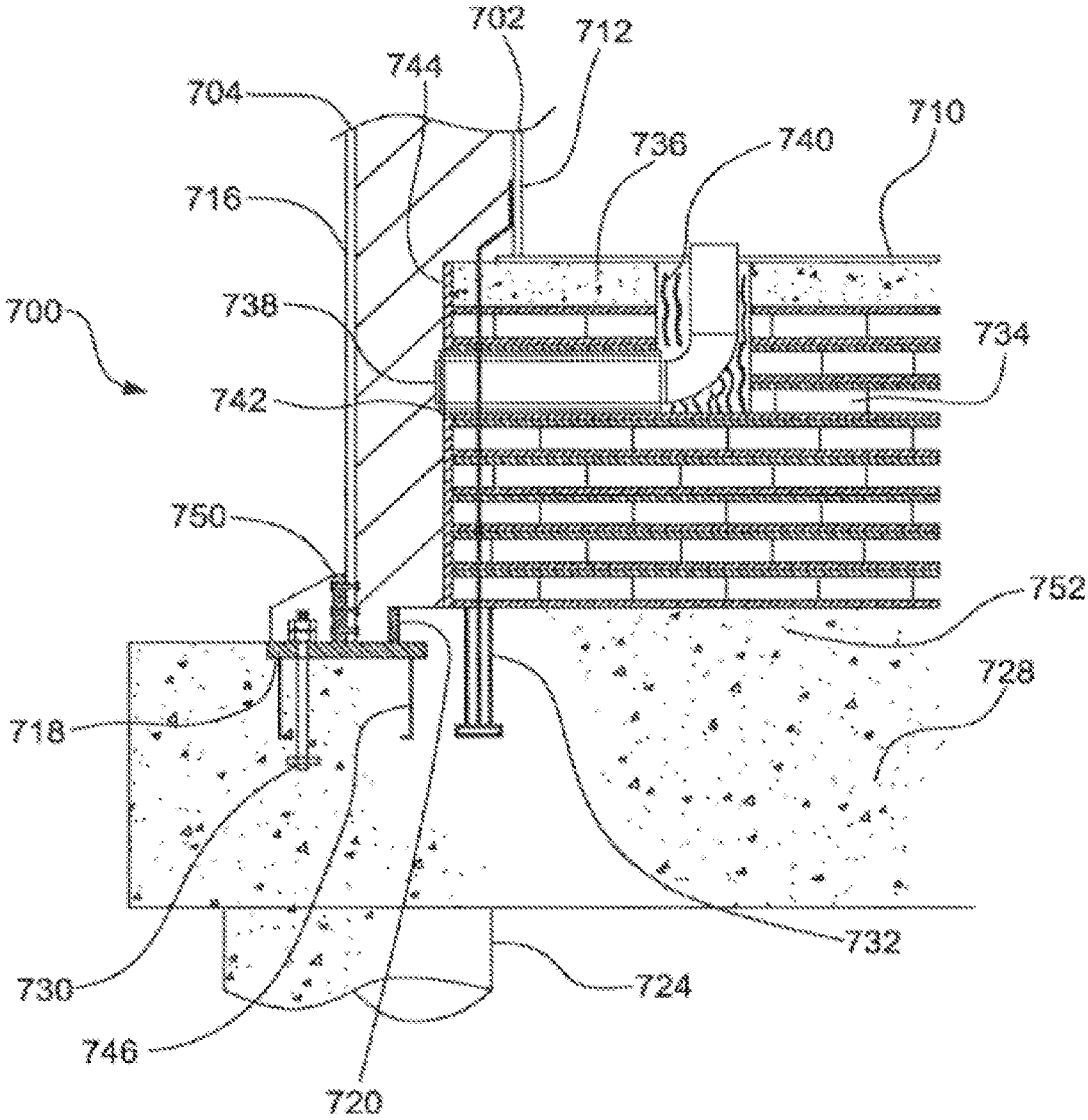
FIG. 8 is a close-up cut-away view of the foundation of an exemplary cryogenic storage tank involving aspects of the invention.

As illustrated in FIG. 8, which is a close-up cut-away view of the lower section of the exemplary cryogenic liquid storage tank 700 in FIG. 7, a liquid withdrawal pipe 738 is inserted through the stainless steel floor plate 710 of the welded stainless steel inner tank 702 and run to a metered tank trailer fill distribution system (not shown) for storage of the cryogenic liquid. Rockwool insulation 740 is wrapped around the liquid withdrawal pipe 738 to provide adequate insulation because the cellular glass blocks 734 are solid and may not be molded to form around the liquid withdrawal pipe 738. A stainless steel box section 742 is installed to form a tunnel way through the cellular glass blocks 734 for the liquid withdrawal pipe 738. A protection ring or retaining wall 744 provides further support to the top layers of foundation of cellular glass blocks 734 and leveling course of concrete 736.

Figure 9A:
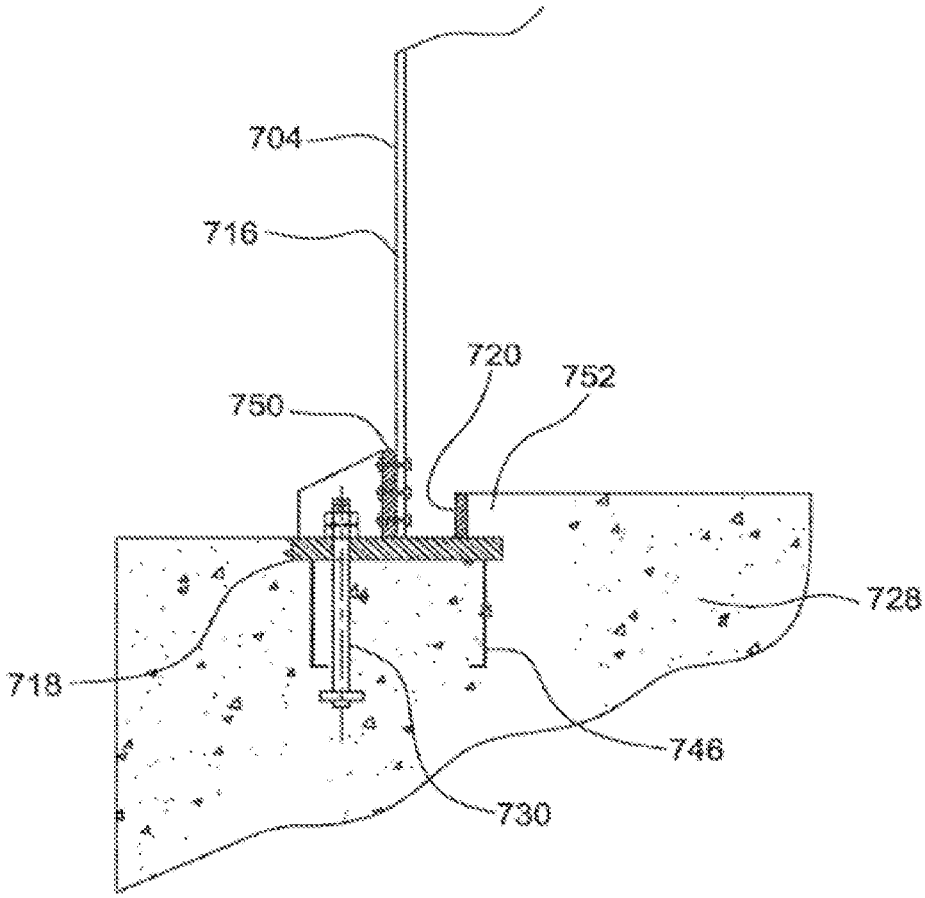
FIG. 9A is a close-up cut-away view of the anchorage of an exemplary cryogenic storage tank involving aspects of the invention.

FIG. 9A, which is a close-up cut-away view of the lower section of the exemplary cryogenic liquid storage tank 700, illustrates that the embedded carbon steel compression ring 718 may be used as a template for the outer tank anchor bolts 730 and welded form bar 720. The welded form bar 720 may be welded to the embedded carbon steel compression ring 718 prior to embedment in the elevated concrete foundation 728 to serve as a form for the elevated concrete foundation 728, and specifically to allow for the raised portion 752 of the elevated concrete foundation 728.

Figure 9B:
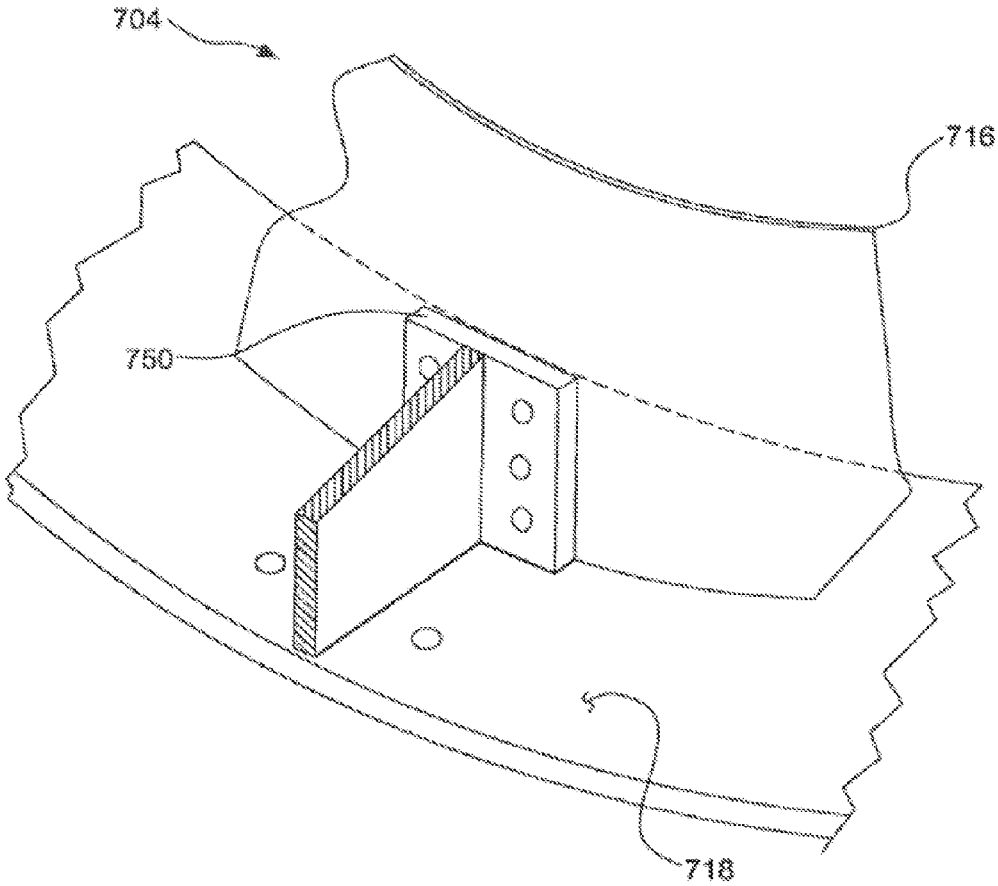
FIG. 9B is a close-up perspective view of the carbon steel anchor brackets of an exemplary cryogenic storage tank involving aspects of the invention.

Carbon steel anchor brackets 750, illustrated in FIGS. 9A and 9B, are located at required regular intervals and spacing along the outer circumference of the carbon steel bolted outer tank 704. The carbon steel anchor brackets 750 are welded to the embedded carbon steel compression ring 718, for example, prior to embedment in the elevated concrete foundation 728. The carbon steel anchor brackets 750 are bolt connected, for example, to the carbon steel bolted outer tank 704.

Figure 10:
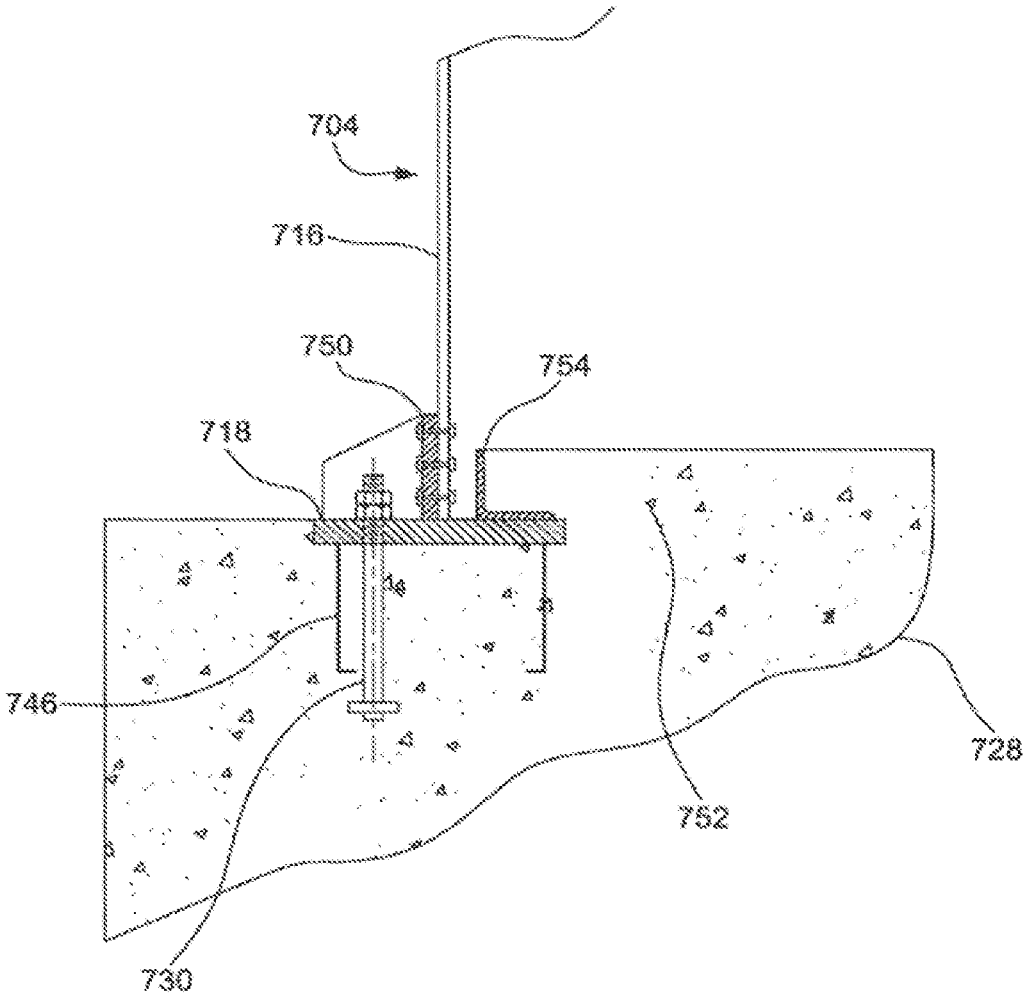
FIG. 10 is a close-up cut-away view of a first alternative anchorage for the exemplary cryogenic storage tank involving aspects of the invention.

Alternatively, and as illustrated in FIG. 10, the form bar 720 may be replaced by a form angle 754.

Figure 11:
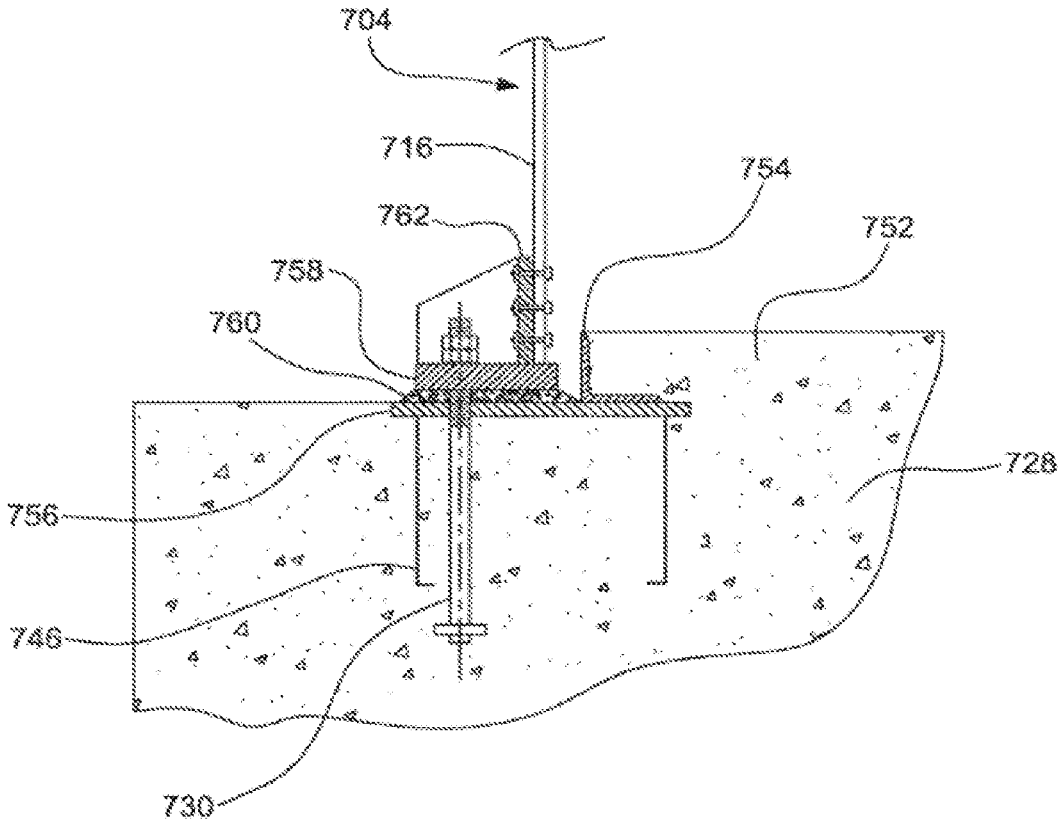
FIG. 11 is a close-up cut-away view of a second alternative anchorage for the exemplary cryogenic storage tank involving aspects of the invention.

Alternatively, as illustrated in FIG. 11, an independent anchor bolt template 756 may be embedded in the elevated concrete foundation 728. The independent anchor bolt template 756 acts as a template for the anchor bolts 730 and angle 754 that is welded to the independent anchor bolt template 756 to enable the concrete to be formed against it. A layer of sealant 760 is placed on top of the independent anchor bolt template 756. The sealant 760 may be an epoxy grout, for example. An independent carbon steel compression ring 758 may then be positioned on top of the layer of sealant 760 and secured to the independent anchor bolt template 756 through the use of anchor bolts 730. Independent carbon steel anchor saddles 762 are welded to the independent carbon steel compression ring 758 at each anchor bolt 730 location along the circumferential bolt circle and then bolted to the carbon steel outer tank staves 716 at these locations.

Figure 12A:
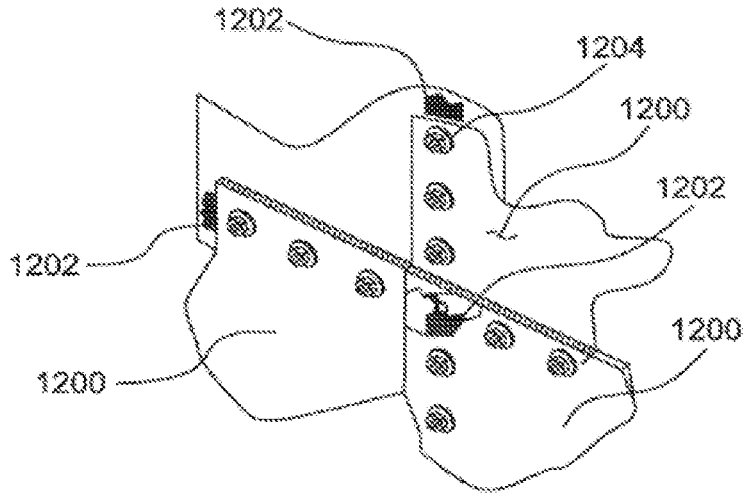
FIG. 12A is a close-up perspective view of a first side of the bolted panel configuration of the exemplary cryogenic liquid storage tank involving aspects of the invention.
Figure 12B:
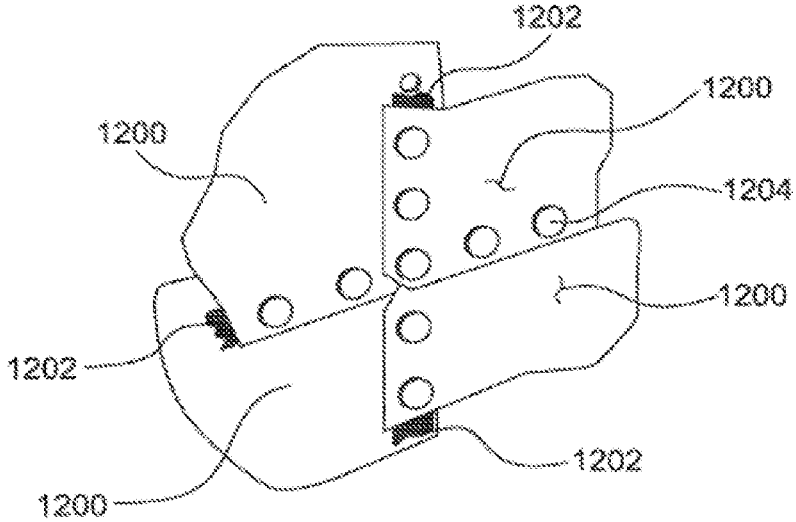
FIG. 12B is a close-up perspective view of a second side of the bolted panel configuration of the exemplary cryogenic storage tank involving aspects of the invention.

FIGS. 12A and 12B illustrate a typical rolled tapered plate carbon steel bolted tank panel sold by, for example, Tank Connection, or Allstate Tanks. FIG. 12A illustrates an exterior view of the typical rolled tapered plate carbon steel bolted tank panel 1200 while FIG. 12B illustrates an interior view. Strip gaskets 1202, are placed in between the individual rolled tapered plate carbon steel bolted tank panels 1200 for sealing purposes. The rolled tapered plate carbon steel bolted tank panels 1200 are affixed together using bolts 1204, for example.

Figure 13:
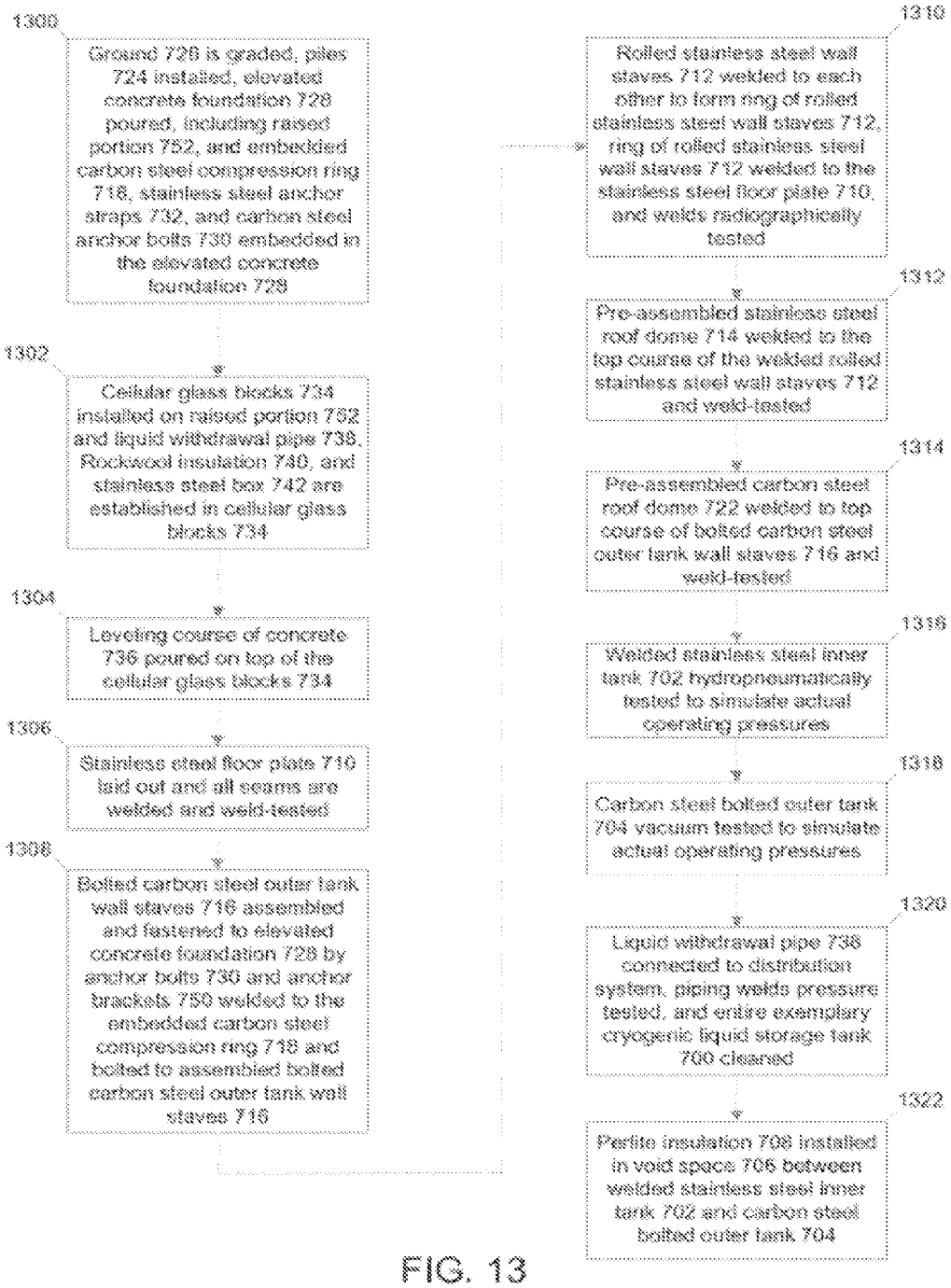
FIG. 13 is a flow chart illustrating the erection sequence for the exemplary cryogenic storage tank involving aspects of the invention.

FIG. 13 illustrates an exemplary erection sequence for the cryogenic liquid storage tank 700. First, the ground 726 is graded, the piles 724 are installed, the elevated concrete foundation 728 is poured, including the raised portion 752, and the embedded carbon steel compression ring 718, stainless steel anchor straps 732, and carbon steel anchor bolts 730 are embedded in the elevated concrete foundation 728 in step 1300. It should be noted the curing of the elevated concrete foundation 728 may take as long as twenty-eight (28) days, for example. Next, the cellular glass blocks 734 are installed on the raised portion 752 and the liquid withdrawal pipe 738, Rockwool insulation 740, and stainless steel box 742 are established in the cellular glass blocks 734 in step 1302. The leveling course of concrete 736 is then poured on top of the cellular glass blocks 734 in step 1304. Again, the leveling course of concrete 736 will require curing time prior to proceeding with the next step. The stainless steel floor plate 710 is then laid out and all the seams are welded and weld-tested in step 1306. The bolted carbon steel outer tank wall staves 716 are then assembled and fastened to the elevated concrete foundation 728 by means of anchor bolts 730 and anchor brackets 750 welded to the embedded carbon steel compression ring 718 and bolted to the assembled bolted carbon steel outer tank wall staves 716 in step 1312. The rolled stainless steel wall staves 712 are then welded to each other to form a ring of rolled stainless steel wall staves 712, the ring of rolled stainless steel wall staves 712 are then welded to the stainless steel floor plate 710, and all welds are radiographically tested in step 1308. The pre-assembled stainless steel roof dome 714 is then welded to the top course of the welded rolled stainless steel wall staves 712 and weld-tested in step 1310. It should be noted that radiographic testing for both the welded stainless steel inner tank 702 and the inner tank 202 is required in accordance with American Society of Mechanical Engineering (ASME) Boiler & Pressure Vessel Code (BPVC), Section V and Section VIII, Division I.

The pre-assembled carbon steel roof dome 722 is welded to the top course of the bolted carbon steel outer tank wall staves 716 and weld-tested in step 1314. The welded stainless steel inner tank 702 is hydropneumatically tested to simulate actual operating pressures in step 1316. The carbon steel bolted outer tank 704 is vacuum tested to simulate actual operating pressures in step 1318.

The liquid withdrawal pipe 738 is connected to the distribution system (not shown), the piping welds are pressure tested, and the entire exemplary cryogenic liquid storage tank 700 is cleaned in step 1320. Finally, perlite insulation 708 is installed in the void space 706 between the welded stainless steel inner tank 702 and carbon steel bolted outer tank 704 in step 1322. The exemplary cryogenic liquid storage tank 700 construction is then complete and it is ready for service.

Alternatively, in step 1310, the rolled stainless steel wall staves 712 may be jacked up and welded to each other until the bottom course of the rolled stainless steel wall staves 712 bear on the stainless steel floor plate 710, where they may be then welded at the vertical joint.

Alternatively, and depending on the space availability of the site, the stainless steel roof dome 714 or the carbon steel roof dome 722 may be assembled on-site.

Alternatively, in step 1308, the base course of bolted carbon steel outer tank wall staves 716 may be assembled first and the higher courses assembled on top of the base course of bolted carbon steel outer tank wall staves 716 subsequently. In yet another alternative, the topmost course of bolted carbon steel outer tank wall staves 716 may be assembled first on top of the embedded carbon steel compression ring 718 and jacked up progressively as lower courses are assembled at man height and jacked up such that the base course of bolted carbon steel outer tank wall staves 716 are assembled last.

Figure 1:
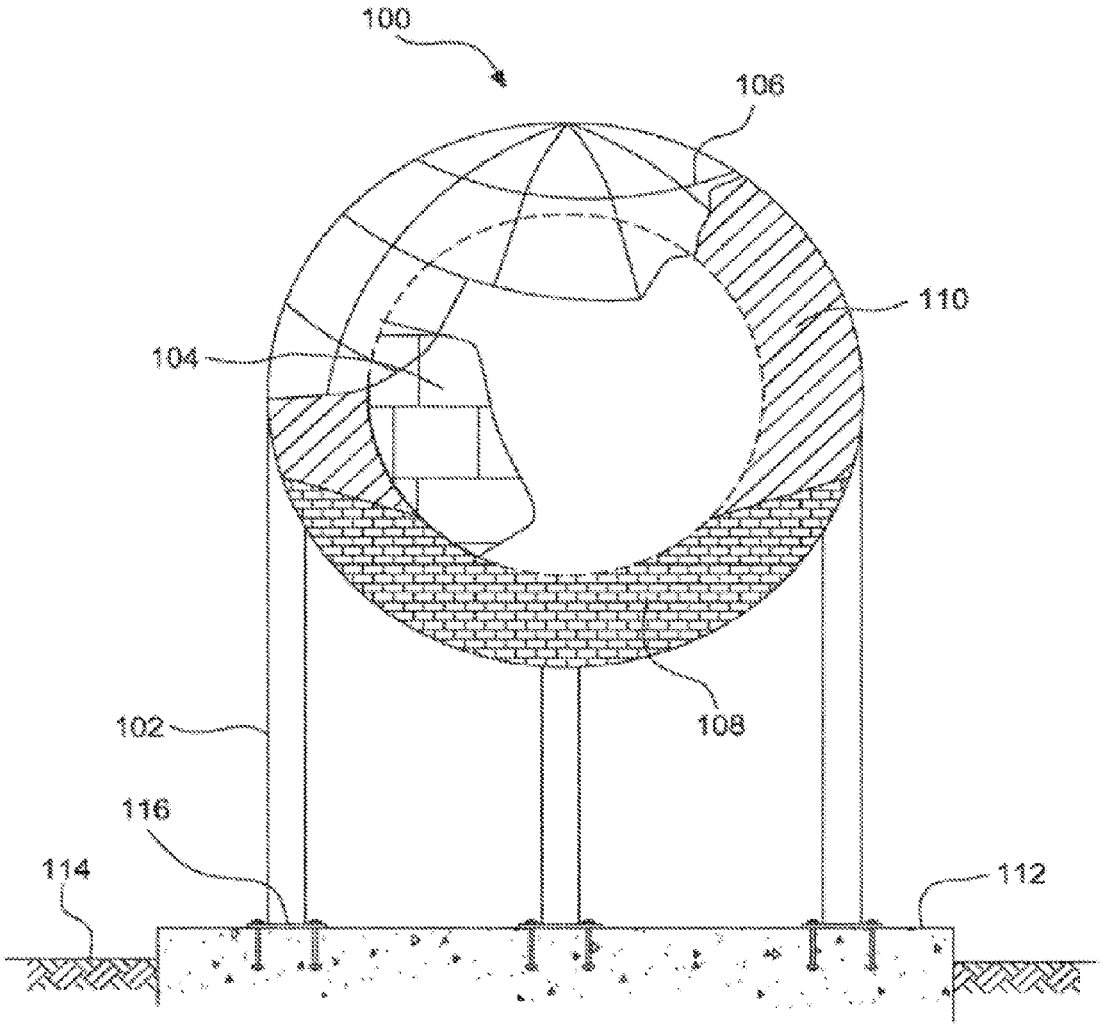
FIG. 1 PRIOR ART
FIG. 1 is a perspective cut-away view of an exemplary spherical doubled walled cryogenic liquid storage tank used prior to traditional welded shell flat bottom cryogenic liquid storage tanks which were in use in the 1950's and early 1960's.
Figure 2:
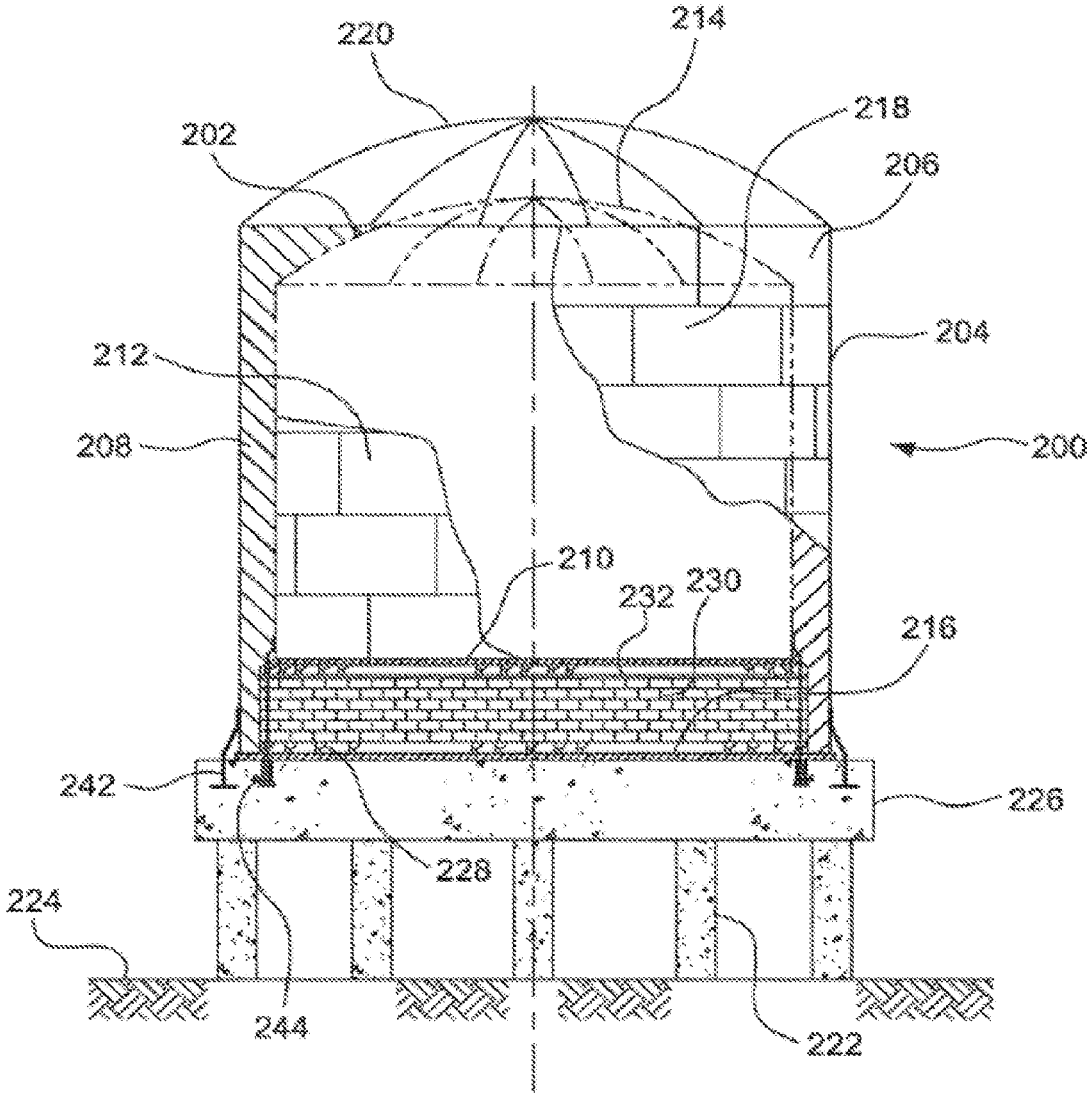
FIG. 2 PRIOR ART
FIG. 2 is a perspective cut-away view of an exemplary traditional welded shell flat bottom cryogenic liquid storage tank currently used today.
Figure 3:
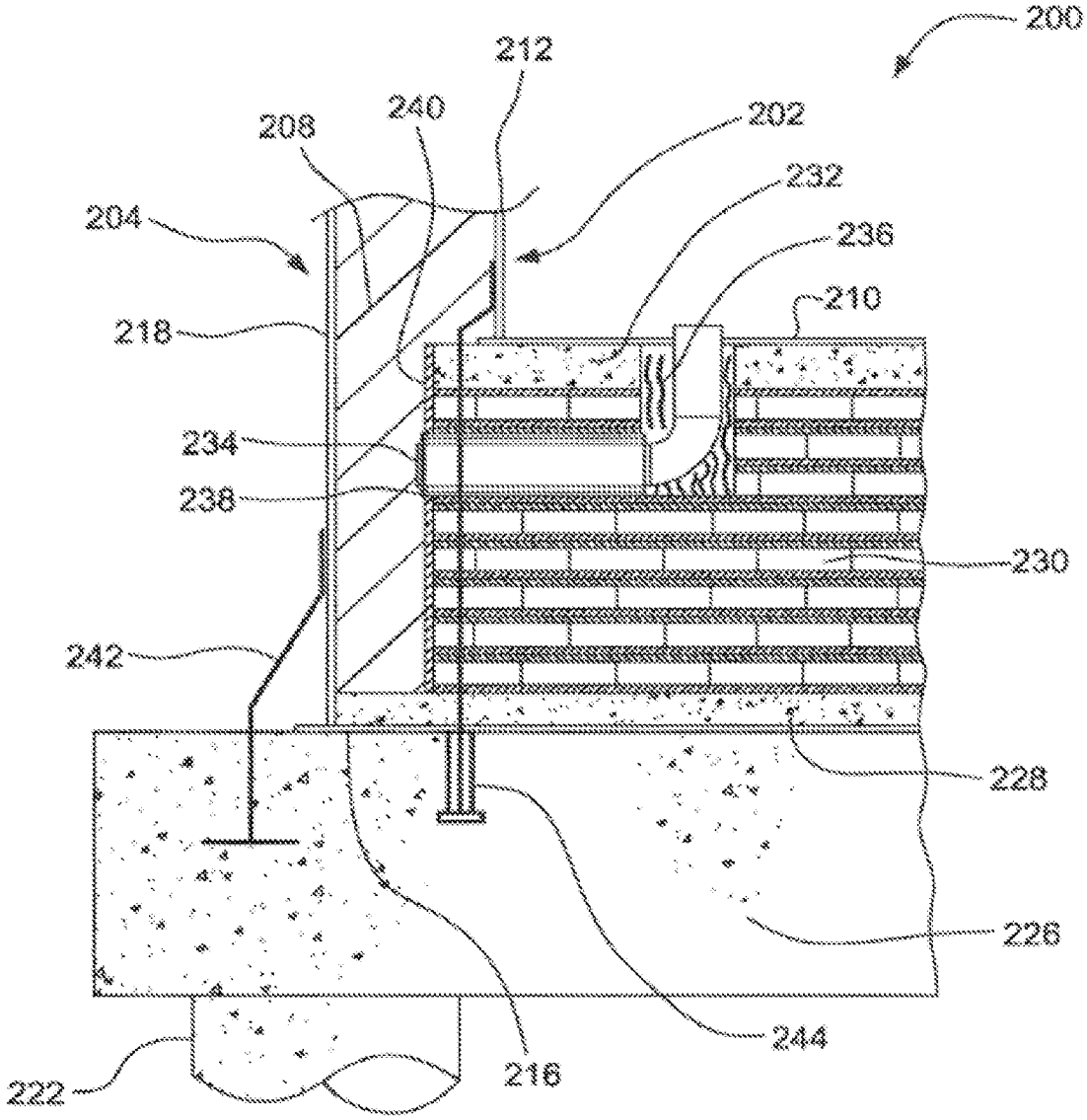
FIG. 3 PRIOR ART
FIG. 3 is a close-up cut-away view of the foundation of an exemplary traditional welded shell flat bottom cryogenic liquid storage tank currently used today.
Figure 4:
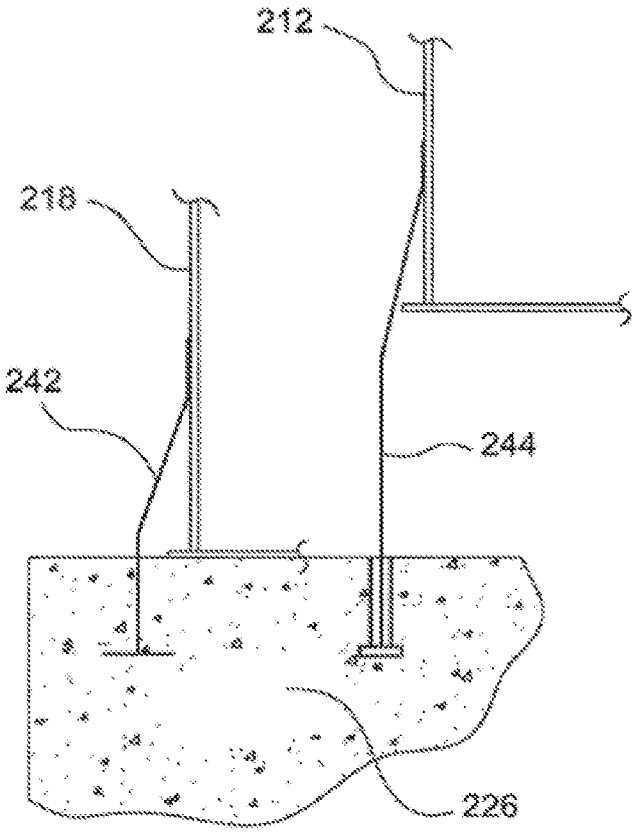
FIG. 4 PRIOR ART
FIG. 4 is a close-up cut-away view of the anchorage of an exemplary traditional welded shell flat bottom cryogenic liquid storage tank currently used today.
Figure 5:
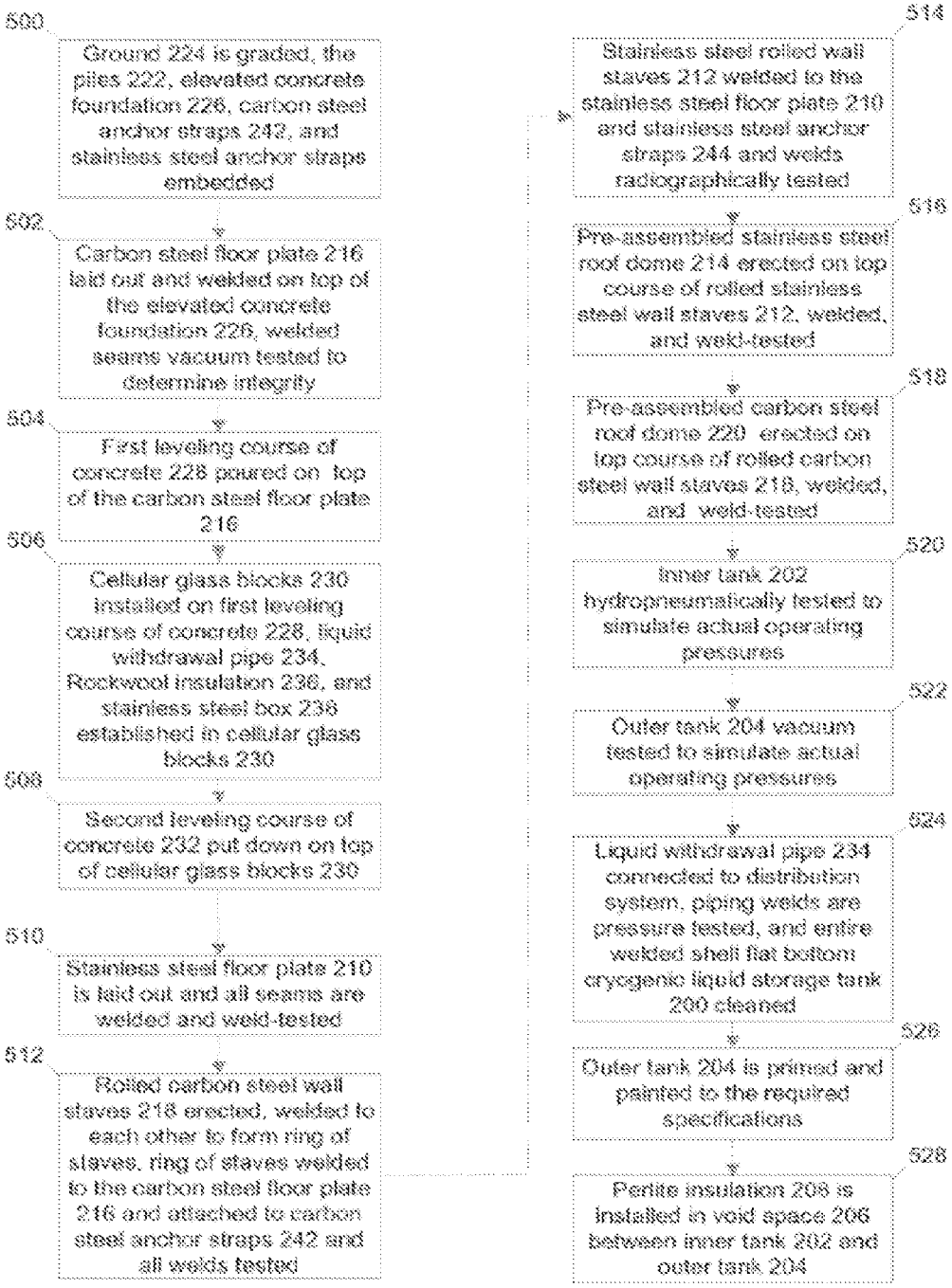
FIG. 5 PRIOR ART
FIG. 5 is a flow chart illustrating the erection sequence for an exemplary traditional welded shell flat bottom cryogenic liquid storage tank currently used today.
Figure 6:
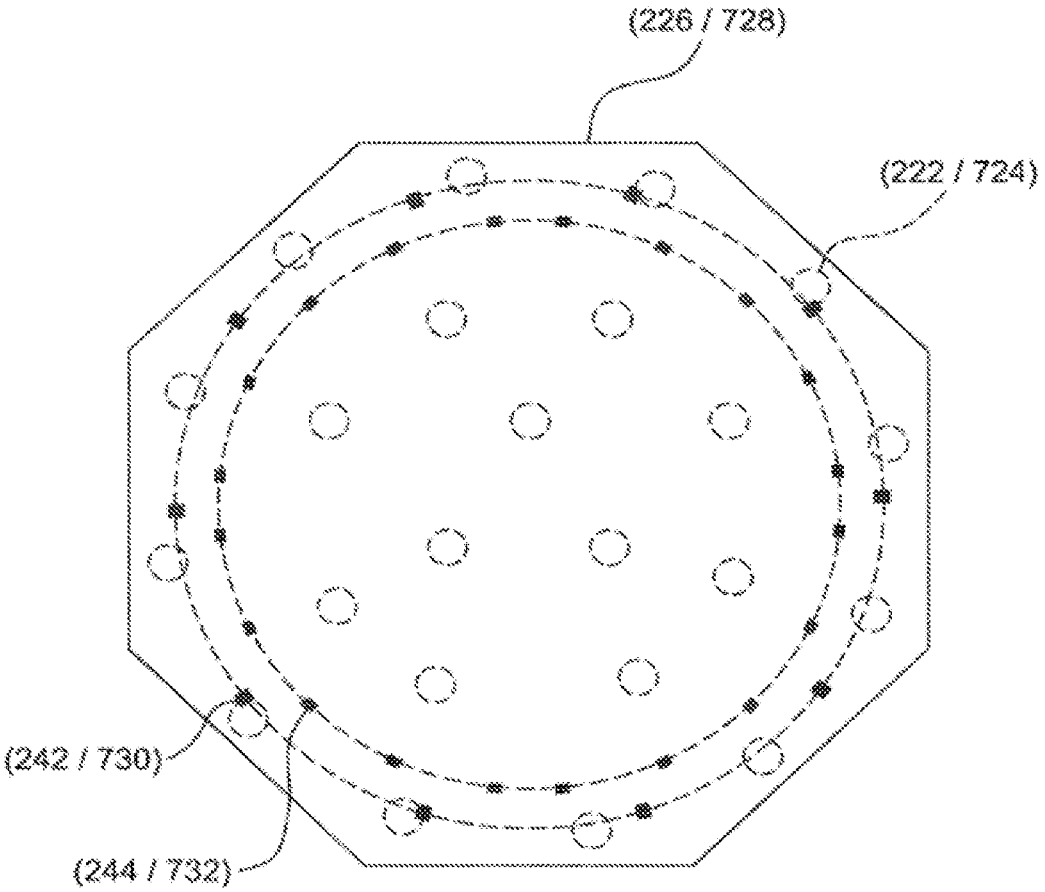
FIG. 6 PRIOR ART
FIG. 6 is a plan view of anchorage locations for both the inner tank and the outer tank of a traditional welded shell flat bottom cryogenic liquid storage tank currently used today.

A comparison of the construction sequences between the traditional welded shell flat bottom cryogenic liquid storage tank 200 and the exemplary cryogenic liquid storage tank 700 in FIGS. 5 and 13 illustrate that many of the construction steps are not required in the construction of the exemplary cryogenic liquid storage tank 700, including all the required welding and testing of welds for the outer tank 204 and the construction of the carbon steel floor plate 216 and the curing time for the additional concrete pours. For example, in the traditional construction of a welded shell flat bottom cryogenic liquid storage tank 200, the carbon steel floor plate 216 is vacuum box tested at the seams. The vacuum testing is completely eliminated in the proposed approach as the carbon steel floor plate 216 is replaced by a peripheral ring (i.e., the embedded carbon steel compression ring 718) which serves as a template, a form, and in some instances, as a compression plate.

Additionally all preparation, priming and painting onsite of the outer tank 204 is completely eliminated because the shell staves of the carbon steel bolted outer tank 704 are shop primed, painted, and cured before delivery to the site. The combined benefits of these actions will eliminate the need for an entire welded seam floor plate and the required vacuum testing of the welds, thus saving weeks of field schedule.

While aspects of the present invention has been described in connection with the preferred embodiments of the various figures, it is to be understood that other similar embodiments may be used or modifications and additions may be made to the described embodiment for performing the same function of the present invention without deviating therefrom. For example, in yet another embodiment, the outer tank may not be constructed as a carbon steel bolted outer tank 704, but may be constructed more like the traditional welded shell outer tank 204. In this embodiment, the welded outer tank comprises rolled welded wall staves and a welded roof dome, but does not comprise a carbon steel floor plate 216. An embedded carbon steel compression ring 718 may be used in conjunction with the elevated concrete foundation 728, raised portion 752, form bar 720, and carbon steel anchor bolts 730 to affix the welded outer tank to the raised portion 752 of the elevated concrete foundation 728. While this embodiment will not have the same cost and time savings of the other embodiments described above, elimination of the carbon steel floor plate 216 and the pour of the first leveling course of concrete 228 will provide some cost and time savings. Additionally, and as noted above, while some emphasis has been placed on using particular materials for the various parts of the cryogenic storage tank, repeated emphasis should not prevent one of ordinary skill in the art to understand that the other materials listed here may also be used for construction of these various parts. Therefore, the claimed invention should not be limited to any single embodiment, but rather should be construed in breadth and scope in accordance with the appended claims.

The invention claimed is:

1. A cryogenic storage tank, comprising:

a concrete foundation comprising a lower portion forming a first upper surface and a raised portion forming a second upper surface, wherein the second upper surface is located above the first upper surface;

a plurality of cellular glass blocks positioned directly on top of the second upper surface of the concrete foundation;

a leveling course of concrete poured on top of the uppermost layer of the plurality of cellular glass blocks;

a mounting apparatus affixed to the concrete foundation, wherein the mounting apparatus comprises a compression ring, and the second upper surface of the concrete foundation is located above the compression ring;

a welded inner tank comprising an inner tank floor plate, a plurality of inner tank wall staves, and an inner tank roof dome, wherein the welded inner tank is positioned on top of the leveling course of concrete; and a bolted outer shell comprising a plurality of bolted outer shell wall staves and an outer shell roof dome, wherein the bolted outer shell is positioned on top of the mounting apparatus, surrounding the welded inner tank, and spaced apart from the welded inner tank such that the plurality of inner tank wall staves are positioned adjacent to the plurality of bolted outer shell wall staves and the inner tank roof dome is positioned adjacent to the outer shell roof dome;

wherein the bolted outer shell is affixed to the mounting apparatus at locations around the periphery of the bolted outer shell;

wherein the compression ring has a plurality of anchor bolt holes to serve as a template for affixing the bolted outer shell to the mounting apparatus and concrete foundation.

2. The tank of claim 1, wherein the bolted outer shell is a carbon steel bolted outer shell.

3. The tank of claim 1, wherein the welded inner tank is a welded stainless steel inner tank.

4. The tank of claim 1, wherein the compression ring is embedded in the lower portion forming the first upper surface of the concrete foundation.

5. The tank of claim 1, wherein the compression ring comprises at least one of a welded form bar or a welded angle.

6. A method for construction of a cryogenic storage tank, comprising the steps of:

pouring and curing a concrete foundation including a lower portion forming a first upper surface and a raised portion forming a second upper surface by using a mounting apparatus embedded in the concrete foundation as a form for the raised portion;

wherein the second upper surface is located above the first upper surface, wherein the mounting apparatus comprises a compression ring, and the second upper surface is located above the compression ring;

installing a plurality of cellular glass blocks on the second upper surface of the poured and cured concrete foundation;

pouring and curing a leveling course of concrete on top of the installed plurality of cellular glass blocks;

installing a floor plate on top of the leveling course of concrete;

installing a plurality of bolted wall staves to the concrete foundation by securing the lowest level of bolted wall staves to the embedded mounting apparatus;

welding a plurality of wall staves to the floor plate;

welding a first roof dome to the highest level of the plurality of welded wall staves to form a welded inner tank; and installing a second roof dome to the highest level of the plurality of bolted wall staves to form a bolted outer shell, wherein the compression ring has a plurality of anchor bolt holes to serve as a template for affixing the outer shell to the mounting apparatus and concrete foundation.

7. The method of claim 6, wherein the bolted wall staves, the second roof dome, and the mounting apparatus are composed of carbon steel, and the floor plate, welded wall staves, and first roof dome are composed of stainless steel.

8. The method of claim 6, further comprising hydropneumatically testing the welded inner tank.

9. The method of claim 6, further comprising vacuum testing the bolted outer shell.

10. The method of claim 6, further comprising installing perlite insulation in a void space between the welded inner tank and the bolted outer shell.

11. The method of claim 6, further comprising installing stainless steel anchor straps to the concrete foundation and the welded inner tank.

12. A cryogenic storage tank constructed in accordance with the method of claim 6.

13. A cryogenic storage tank, comprising:

a welded inner tank;

an outer shell surrounding the welded inner tank;

a concrete foundation comprising a lower portion forming a first upper surface and a raised portion forming a second upper surface that are poured along with the remainder of the concrete foundation, wherein the second upper surface is located above the first upper surface;

a plurality of cellular glass blocks positioned directly on top of the second upper surface raised portion of the concrete foundation, at least some of the plurality of cellular blocks directly contacting the raised portion second upper surface of the concrete foundation;

a leveling course of concrete poured on top of the uppermost layer of the plurality of cellular glass blocks; and a mounting apparatus affixed to the concrete foundation, the mounting apparatus comprising a compression ring located below the second upper surface of the concrete foundation;

wherein the welded inner tank is positioned on top of the leveling course of concrete and the outer shell is affixed to the mounting apparatus at locations around the periphery of the outer shell, wherein the compression ring has a plurality of anchor bolt holes to serve as a template for affixing the outer shell to the mounting apparatus and concrete foundation.

14. The tank of claim 13, wherein the welded inner tank is a stainless steel inner tank, the outer shell is a carbon steel bolted outer shell comprising a plurality of bolted outer shell wall staves, the concrete foundation is an elevated concrete foundation, and the mounting apparatus is a carbon steel compression ring.

15. The tank of claim 1, wherein the raised portion is in contact with the lower portion.

16. The tank of claim 13 wherein the mounting apparatus further comprises at least one of a welded form bar or angle that acts as a form for the raised portion when pouring the concrete foundation.

* * * * *